US005769468A

United States Patent [19]

Armbruster

[11] Patent Number: 5,769,468

[45] Date of Patent: Jun. 23, 1998

[54] POWER-ASSIST MOTOR-VEHICLE DOOR LATCH

[75] Inventor: Stefan Armbruster, Essen, Germany

[73] Assignee: Kiekert AG, Heiligenhaus, Germany

[21] Appl. No.: 650,135

[22] Filed: May 17, 1996

[30] Foreign Application Priority Data

Aug. 18, 1995 [DE] Germany ..... 195 30 728.3

[51] Int. Cl.[6] ..... E05C 3/06

[52] U.S. Cl. ..... 292/201

[58] Field of Search ..... 292/201, DIG. 43, 292/216, DIG. 14, 1

[56] References Cited

U.S. PATENT DOCUMENTS

| | | | |
|---|---|---|---|
| 4,518,180 | 5/1985 | Kleefeldt et al. | 292/201 |
| 4,948,183 | 8/1990 | Yamada | 292/201 X |
| 5,074,603 | 12/1991 | Brackmann | 292/DIG. 43 X |
| 5,423,582 | 6/1995 | Kleefeldt | 292/201 |
| 5,454,607 | 10/1995 | Ishihara et al. | 292/DIG. 43 X |

*Primary Examiner*—Rodney M. Lindsey
*Attorney, Agent, or Firm*—Herbert Dubno; Andrew Wilford

[57] ABSTRACT

A motor-vehicle door latch has a fork formed with a detent and pivotal from a latched position retaining a bolt deep, a semilatched position retaining the bolt shallow, and an unlatched position permitting the bolt to enter and exit the latch. A main rocker coaxial with the fork can pivot with the fork between the latched and semilatched positions and a drive is connected to the main rocker for pivoting same about the main axis between the latched and semilatched positions. A pawl pivoted on the main rocker about a secondary axis offset from the main axis is provided offset from the axes with an axially projecting actuator pin and can move between an inner position engaging the detent and rotationally coupling the fork to the main rocker and an outer position clear of the detent and permitting the fork to rotate independently of the main rocker. A secondary rocker pivoted on the main axis is provided with a cam formation having a lifting portion engageable with the actuator pin to displace the pawl from its inner position to its outer position and a holding portion engageable with the actuator pin to retain it in its outer position. A coupling and formations on the fork and main rocker in the semilatched position hold the pawl with the holding portion in the outer position and in the unlatched position hold the actuator pin out of engagement with the holding portion.

5 Claims, 10 Drawing Sheets

POWER-ASSIST MOTOR-VEHICLE DOOR LATCH

FIELD OF THE INVENTION

The present invention relates to a motor-vehicle door latch. More particularly this invention concerns such a latch having a power assist.

BACKGROUND OF THE INVENTION

A standard motor-vehicle door latch comprises a housing and a fork formed with a detent and pivotal about a main axis on the housing from a latched position retaining a bolt deep in the housing, a semilatched position retaining the bolt shallow in the housing, and an unlatched position permitting the bolt to enter and exit the housing. A main rocker is pivotal about the main axis on the housing with the fork between the latched and semilatched positions. A rotary drive connected to the main rocker pivots same about the main axis between the latched and semilatched positions and a pawl pivoted on the main rocker about a secondary axis offset from the main axis is provided offset from the axes with an axially projecting actuator pin and can be moved between an inner position engaging the detent and rotationally coupling the fork to the main rocker and an outer position clear of the detent and permitting the fork to rotate independently of the main rocker.

Such a latch is typically used on a trunk lid and is mainly set up for operation by remote control. When the remote transmitter is operated it displaces the main rocker from the latched to the open position. When the door or trunk lid is subsequently closed, this action pushes the fork and main rocker back to the semilatched position whereupon the motor takes over and pulls the latch back into the latched position. Typically the control for the trunk or door latch is integrated in a control system for the vehicle doors and, in some models, also for a sun roof, alarm system, and/or windows.

The fork is typically urged into the open position by a spring and the pawl is urged into the inner position by another spring. The semilatched position can actually be an open-ready position in which the pawl is clear of the fork so the door can be opened manually or by means of the fork spring and a similar close-ready position in which the pawl is engaged with the fork and the door can be pulled tightly closed by the drive.

U.S. Pat. No. 5,423,582 of Kleefeldt describes a motor-vehicle door latch for use in combination with a door bolt and having a housing formed with a laterally open recess in which the bolt is receivable and a pivotal latch fork formed with a fork seat and with at least one detent and pivotal on the housing between latched, semilatched, and unlatched positions. A support link pivotal on the housing carries a latch pawl pivotal in the latched and semilatched positions of the fork into and out of a holding position engaging the detent and preventing pivoting of the fork into the unlatched position. A crank is rotatable adjacent the fork between an outer position relatively far from the fork and an inner position relatively close to the fork and through an open-ready intermediate position between the inner and outer positions and close to the outer position. This crank is connected by a link to the support link for pivoting the support link and retaining pawl as the crank rotates. A stop on the housing engages a tooth of the pawl in the intermediate and outer positions of the crank, is out of engagement with the tooth in the inner position, and is positioned such that on displacement of the crank from the open-ready intermediate to the outer position the stop pivots the pawl out of engagement with the fork.

In this arrangement there is no actuation of the latch from the open-ready position to the unlatched position, so that the pawl always engages the fork and can always catch on its detent. Another disadvantage of this system is that once the latch starts to move from the close-ready position to the latched position there is no stopping, so that, if something like an article of clothing or finger is caught in the door, the door must be fully closed before it can be opened again.

OBJECTS OF THE INVENTION

It is therefore an object of the present invention to provide an improved motor-vehicle door latch.

Another object is the provision of such an improved motor-vehicle door latch which overcomes the above-given disadvantages, that is which can be counted on to open the door, even if same is blocked shut, and which can be reversed to prevent pinching or damaging something caught in the door.

SUMMARY OF THE INVENTION

A motor-vehicle door latch has according to the invention a housing and a fork formed with a detent and pivotal about a main axis on the housing from a latched position retaining a bolt deep in the housing, a semilatched position retaining the bolt shallow in the housing, and an unlatched position permitting the bolt to enter and exit the housing. A main rocker can pivot about the main axis on the housing with the fork between the latched and semilatched positions and a drive is connected to the main rocker for pivoting same about the main axis between the latched and semilatched positions. A pawl pivoted on the main rocker about a secondary axis offset from the main axis is provided offset from the axes with an axially projecting actuator pin and can move between an inner position engaging the detent and rotationally coupling the fork to the main rocker and an outer position clear of the detent and permitting the fork to rotate independently of the main rocker. A secondary rocker pivoted on the main axis is provided with a cam formation having a lifting portion engageable with the actuator pin to displace the pawl from its inner position to its outer position and a holding portion engageable with the actuator pin to retain it in its outer position. A coupling and formations on the fork and main rocker in the semilatched position hold the pawl with the holding portion in the outer position and in the unlatched position hold the actuator pin out of engagement with the holding portion.

The coupling works with delayed action or lost motion to force the secondary rocker to follow the movements of the main rocker, but with a minor delay. The coupling establishes when the actuator pin is on the lifting portion or holding portion of the secondary rocker. The holding portion is set up such that the pawl is held completely off the fork and the lifting portion, which ends where the holding portion starts, serves to lift the pawl on relative shifting of the main and secondary rockers.

When the door is closed the actuator pin is on the lifting portion so that the closing movement can be interrupted and even reversed at any time, without having to reach the end closed position. Thus if, for instance, a finger gets caught in the door the drive can be reversed instantaneously to release it. Since the pawl is held clear of the fork in the open-ready position, it cannot engage the forks detent before the fork has freed the bolt, that is when the latch is fully opened.

According to the invention the coupling includes an arcuate sector of teeth centered on the main axis on the housing, an elongated circularly arcuate slot formed in the fork centered on the main axis and having an enlarged end formed with a pair of angled camming surfaces, and a lever pivoted on the secondary rocker and having a control pin engaged in the slot. The lever has one arm provided with teeth and another arm provided with an axially extending control pin. The lever is pivotal between an arrested position corresponding to engagement of the control pin in the enlarged end with the lever teeth engaged with the housing teeth and a pivotal position with the lever teeth disengaged from the housing teeth and the control pin out of the enlarged end. A formation on the secondary rocker can angularly engage the main rocker, and a spring urges the secondary rocker toward the main rocker.

In accordance with a further feature of the invention an actuating lever pivotal on the housing about an axis offset from and parallel to the main axis is formed with a slot centered on the main axis and slidably receiving the actuator pin. A switch is operable by the actuating lever on displacement from the actuator pin between its positions. This switch is connected to a control system for the drive.

The drive according to the invention includes a reversible drive motor having a rotary output, a pinion fixed on the output, a sector gear meshing with the pinion, and a rigid link having one end pivoted on the sector gear and an opposite end pivoted on the main rocker.

The latch according to this invention is particularly suitable for use with a trunk lid, with the latch itself mounted on an edge of the opening the lid fits to and the bolt being provided on the lid itself. The drive motor can be operated by a bistable relay which in the off position latches the lid and in the on position opens it. A switch which may also be remotely controlled can operate this relay. Normally the drive motor is a stepping motor which can be incorporated in a system for aligning the lid properly. In other words during the original installation of the door the drive motor is moved in steps until the door is perfectly aligned in its opening and this position is recorded. Subsequently each time the door is closed, the drive motor is stepped to the same position to reproduce the desired alignment.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
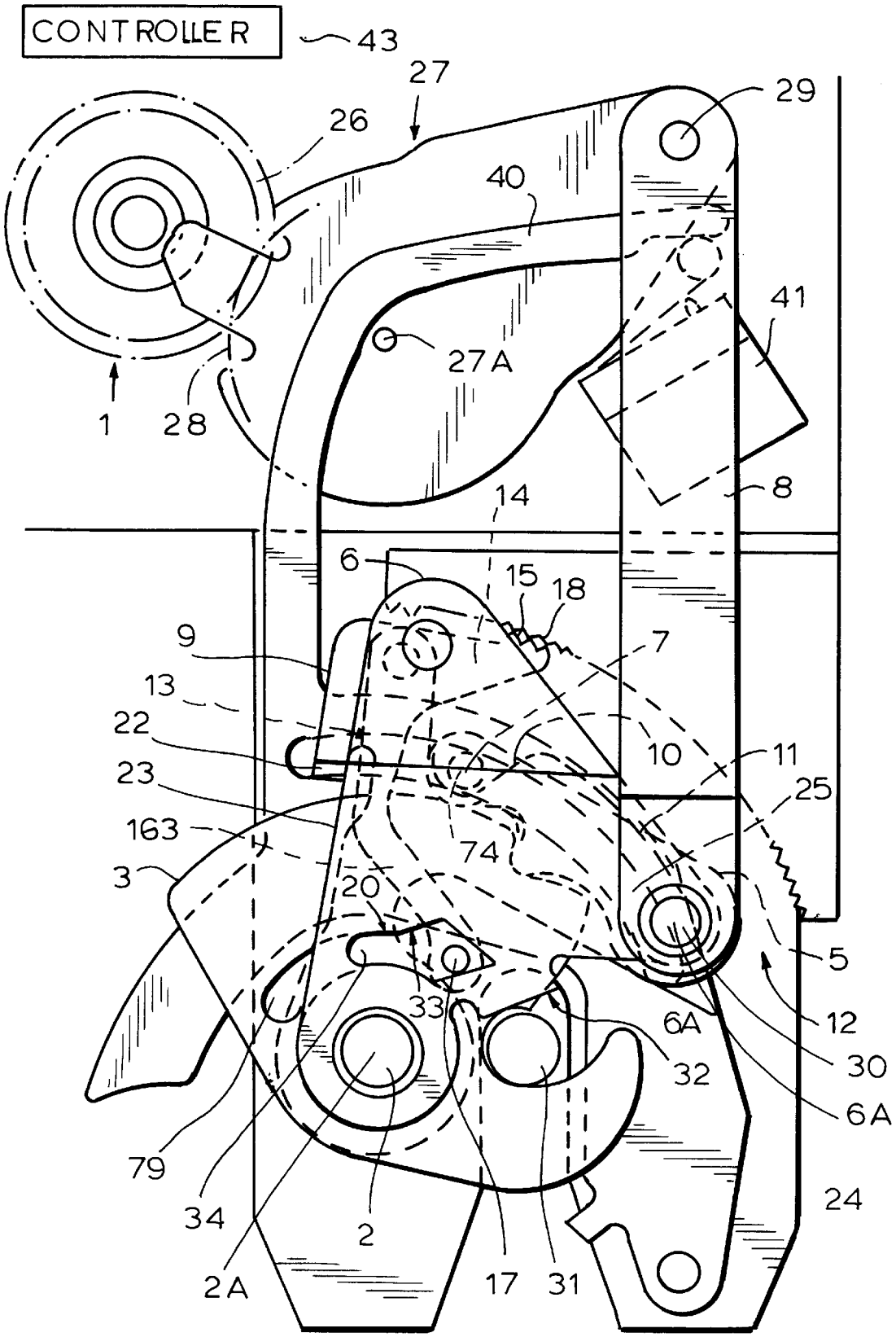
FIG. 1 is a partly diagrammatic side view of the latch of this invention.
Figure 2:
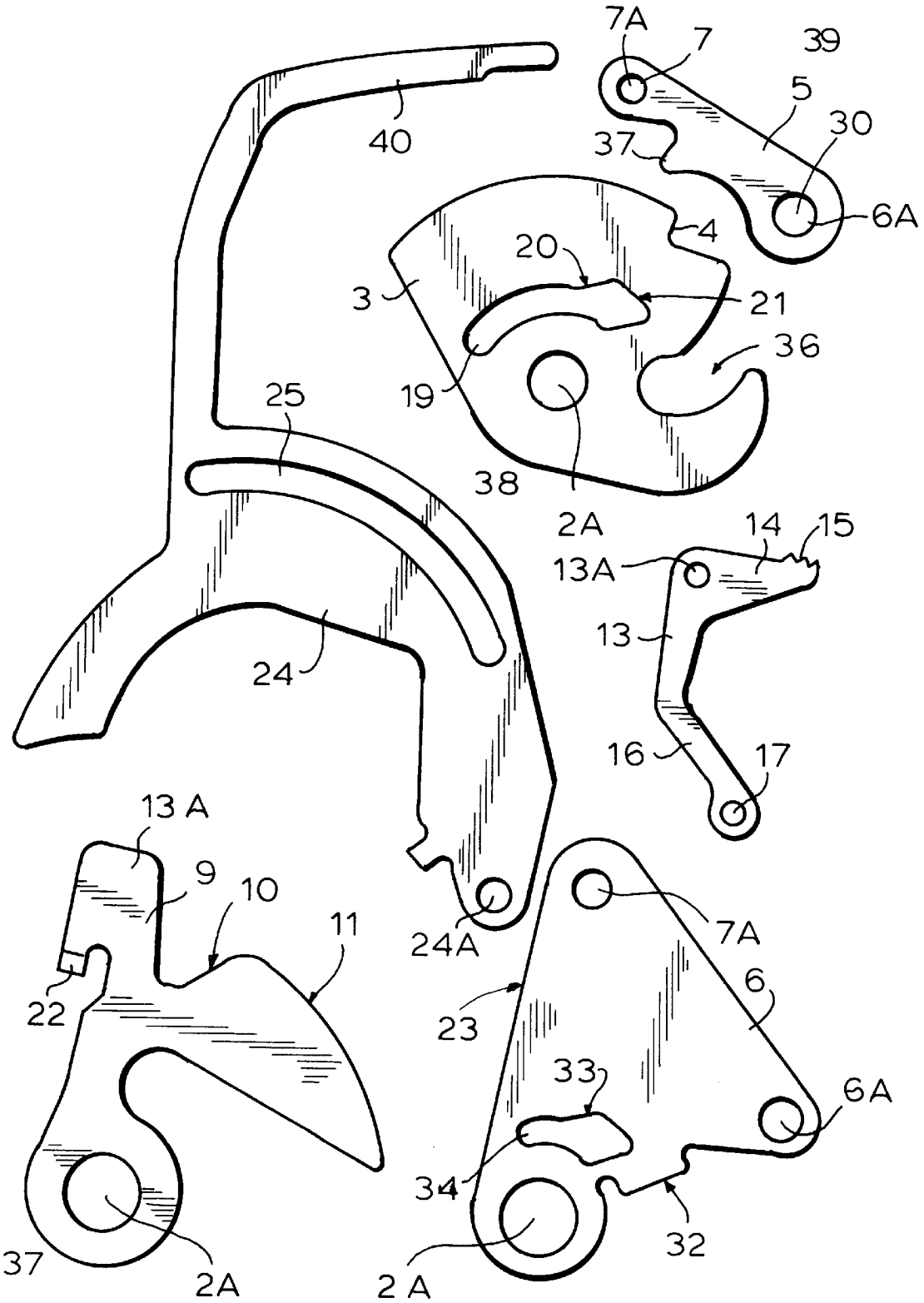
FIG. 2 is an exploded view of elements of the latch.
Figure 10:
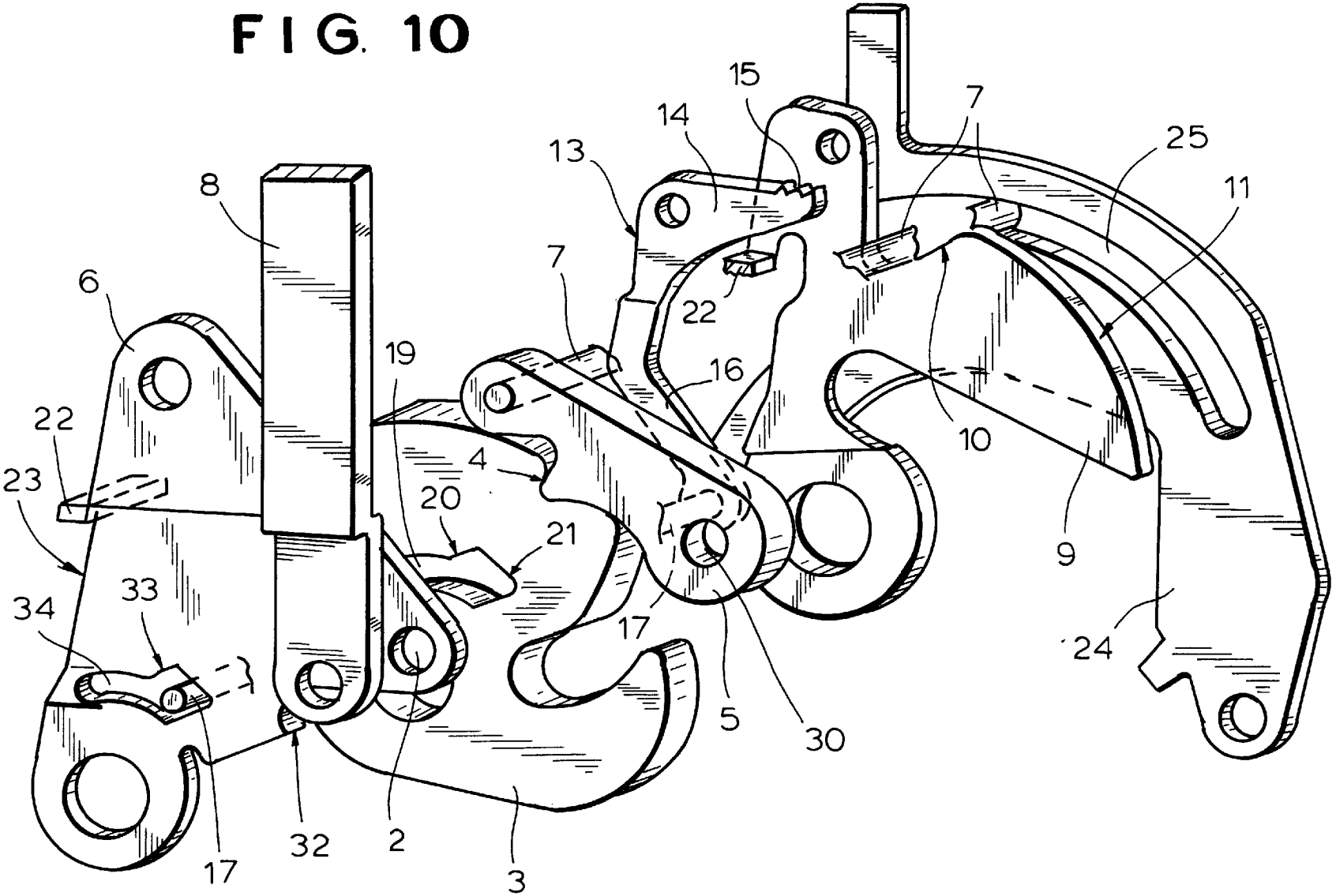
FIG. 10 is an exploded perspective view of the elements of the latch.

As seen in FIGS. 1 2, and 10 a latch according to the invention is powered by a rotary drive 1 and has a housing 35 normally secured in a motor-vehicle body adjacent a trunk lid having a latching bolt 31, although it would be standard to mount the latch housing 35 in the door with the bolt 31 on the door post. A fork 3 mounted on a pivot 2 defining a main axis 2A has a mouth 36 that can engage around the bolt 31 which in the closed position is adjacent and parallel to the pivot 2. A torque spring illustrated schematically in FIG. 2 at 38 urges the fork 3 toward an open position described below. An outwardly open detent recess or notch 4 is formed in the fork 3 and a pawl 5 formed with a hole 30 defining a pivot axis 6A is carried on a first or main rocker plate 6 pivotal about the axis 2A. This pawl 5 has a tooth 37 and is urged radially toward the fork 3 by a torque spring 39 so that the tooth 37 can in the closed position engage the detent 4 and hold the fork 3 against pivoting in the clockwise opening direction. The rocker plate 6 has an edge tab 32 engageable with the bolt 31 as described below. An actuating pin 7 extends along an axis 7A parallel to the axes 2A and 6A from the outer end of the pawl 5.

A rigid pusher link 8 has a lower end pivoted on the rocker plate 6 at 6A and an upper end pivoted at 29 on a sectorlike drive element 27 pivotal about an axis 27A and having teeth 28 meshing with the teeth of a pinion 26 carried on the reversible drive motor 1. Thus this drive 1 can angularly displace the plate 6 and thereby, when the tooth 37 is engaged in the detent 4, also pivot the fork 3. The motor 1 is a stepping-type motor operated by a central controller 43.

According to the invention a secondary rocker plate 9 also carried on the pivot 2 has an angled control edge 10 that can engage the pin 7 and cam the pawl 5 into an outer position in which its tooth 37 is unengageable with the detent 4. The secondary rocker 9 also has a circularly arcuate control edge 11 that is centered on the axis 2A and spaced therefrom by a distance such that when it engages the pin 7 it holds the pawl 5 out of contact with the fork 3. This secondary rocker 9 also has a laterally bent-out tab 22 that can engage an edge 23 of the main rocker 6, another torque spring 37 being provided to urge the rocker 9 clockwise so that, unless something is preventing it, the tab 22 normally rests against the edge 23 and the rockers 6 and 9 pivot together.

A lost-motion or delayed-action coupling 12 is provided between the secondary rocker 9 and the main rocker 6 so that the secondary rocker 9, which is responsible for disengaging the pawl 7 from the fork 3, does not move with the main rocker 6 at the start of its opening movement. This coupling 12 is constituted as a two-arm lever 13 having a pivot at 13A on the rocker 9 and an outer arm 14 formed with teeth 15 engageable with teeth 18 formed in the housing 35 in an arc centered on the axis 2A and another leg 16 having at its end a second coupling pin 17 extending parallel to the axes 2A, 6A, 7A, and 13A. This pin 17 engages through slots 19 and 34 respectively formed in the fork 3 and the main rocker 6 and generally extending arcuately centered on the axis 2A. The slot 19 has an enlarged end which is formed with a pair of camming flanks 20 and 21 and which allows the pin 17 to assume an outermost position in which its teeth 15 engage the teeth 18 to lock the lever 13 as well as the rocker 9 against rotation about the axis 2A. The slot 34 is similarly formed with an enlarged end 33 and the enlarged ends of the slots 19 and 34 are axially aligned in the fully closed position of FIG. 1. A torque spring illustrated schematically at 42 urges the lever 13 so that its teeth 15 are biased into engagement with the teeth 18.

An actuating lever 24 is pivoted at an axis 24A offset from the axis 2A on the housing 35 and has an arcuate slot 25 generally centered on the axis 2A. This lever 24 has an arm 40 engageable with a switch 41 connected to the controller 43. The pin 7 passes through the slot 25 and when the pawl 5 is pushed out to release the fork 3 the arm 40 is pivoted to actuate the switch 41. Thus the switch 41 can report when the system is latched.

Figure 3:
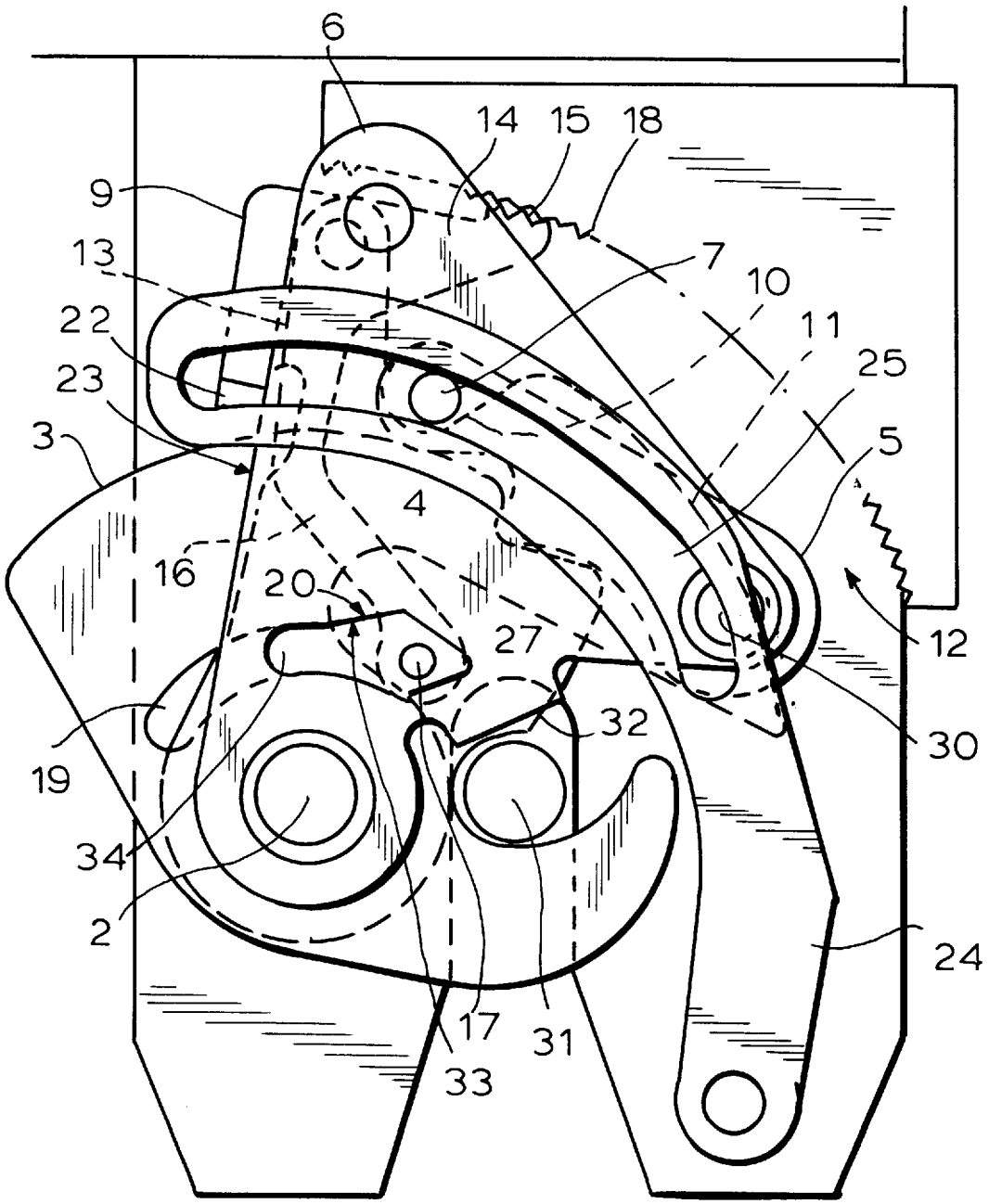
FIGS. 3 through 9 are views illustrating successive positions of the latch as it is opened.
Figure 4:
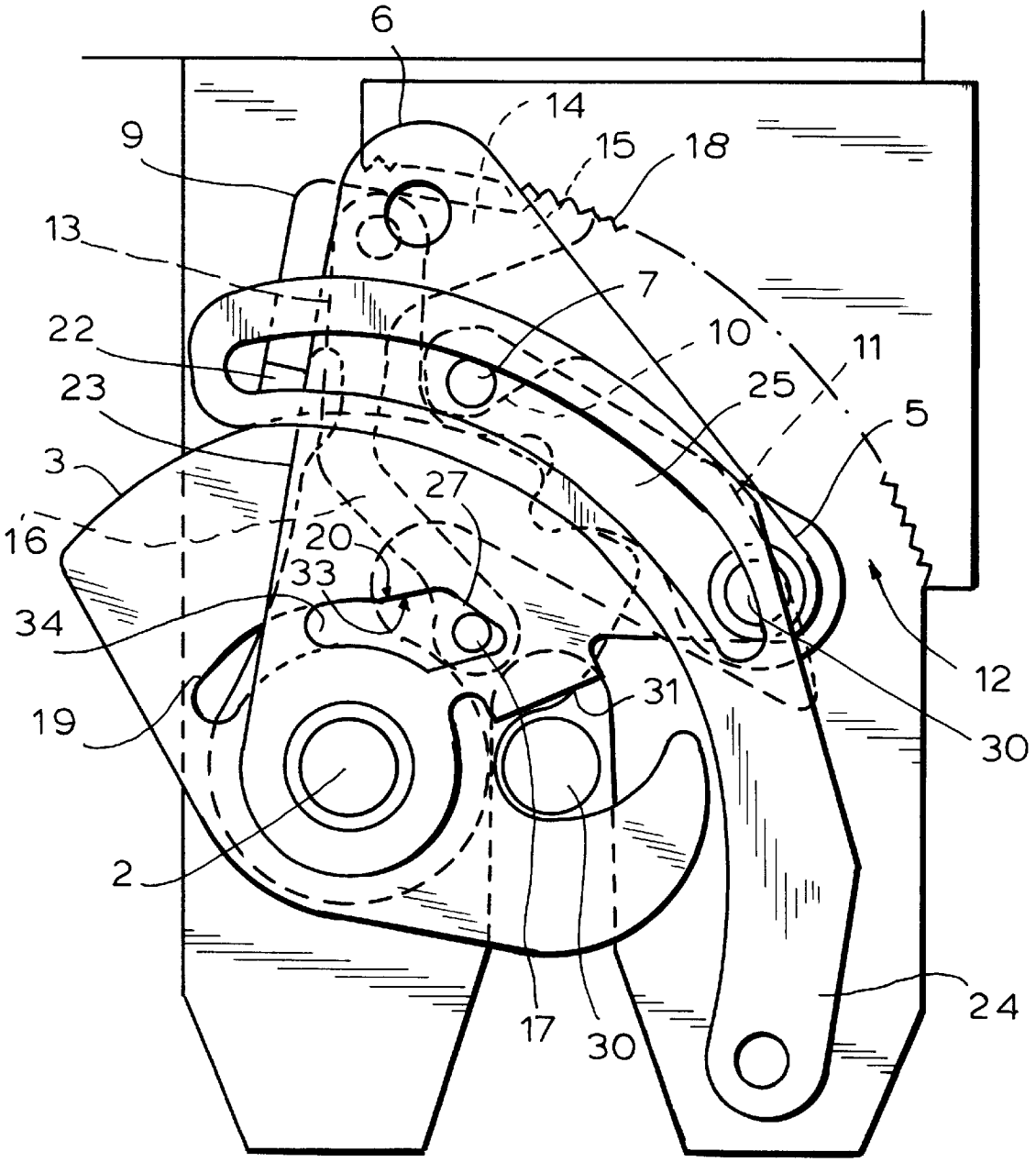
Figure 5:
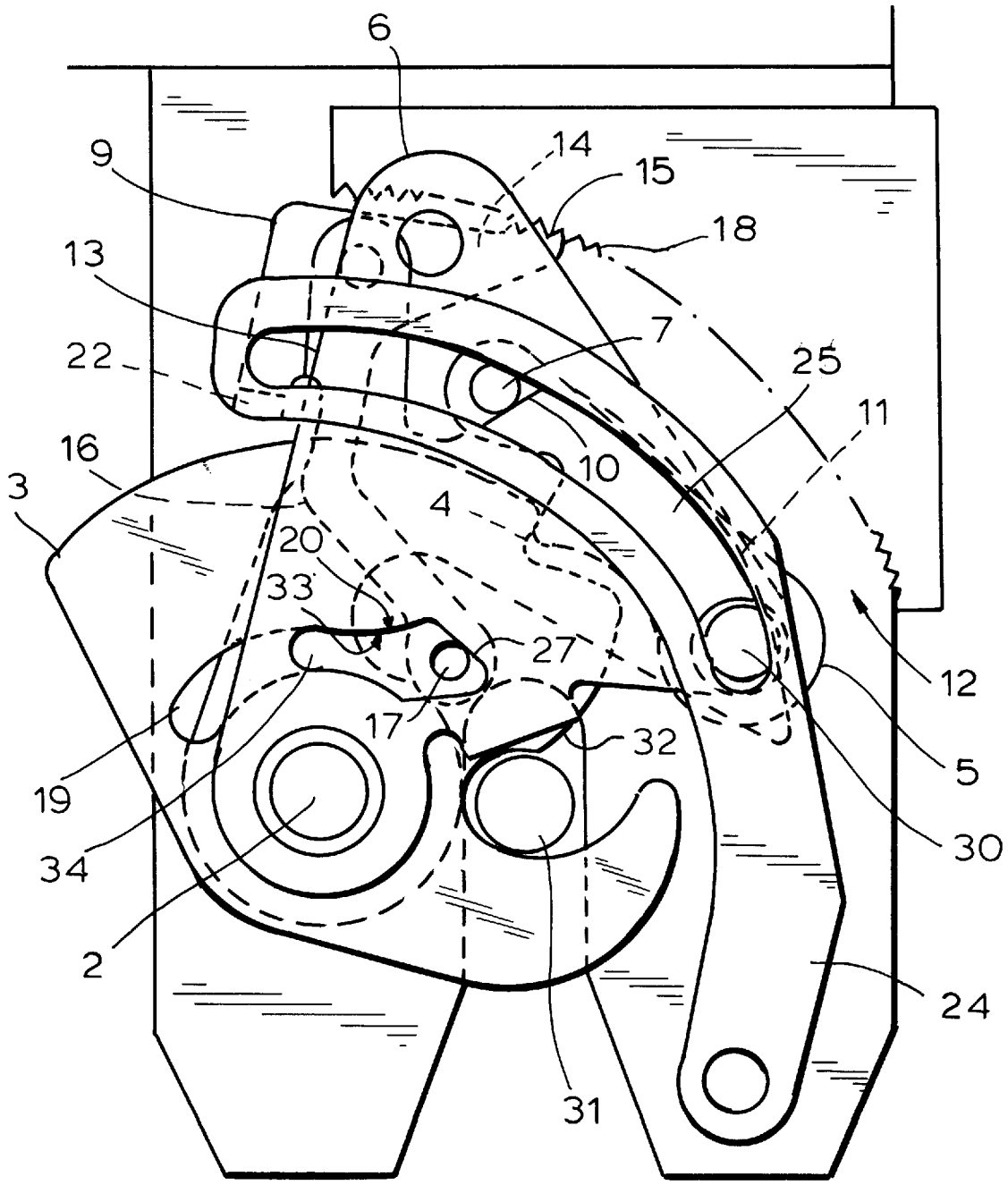

This system operates as follows as shown in FIGS. 3 through 9. First of all the motor 1 rotates the gear 26 counterclockwise to oppositely pivot the crank 27 and push down the link lever 8. This action initially as shown in FIGS. 3 and 4 moves the pivot axis 6A down, allowing the pawl 5 and fork 3 to pivot clockwise along with the main rocker 6. The secondary rocker 9 does not move because the pin 17 is engaged in the enlarged ends of the slots 19 and 34 and the teeth 15 and 18 are therefore engaged so that the arm 13 and the rocker 9 it is mounted on are held against pivoting. The edge 23 separates from the tab 22. FIG. 5 shows the latch in the semilatched condition with the fork 3 pivoted out somewhat but the tooth 37 still engaging the detent 4. In this position, however, the pin 7 is starting to ride up on the cam edge 10 of the stationary secondary rocker 9 to pull the pawl 5 away from the fork 3.

Figure 6:
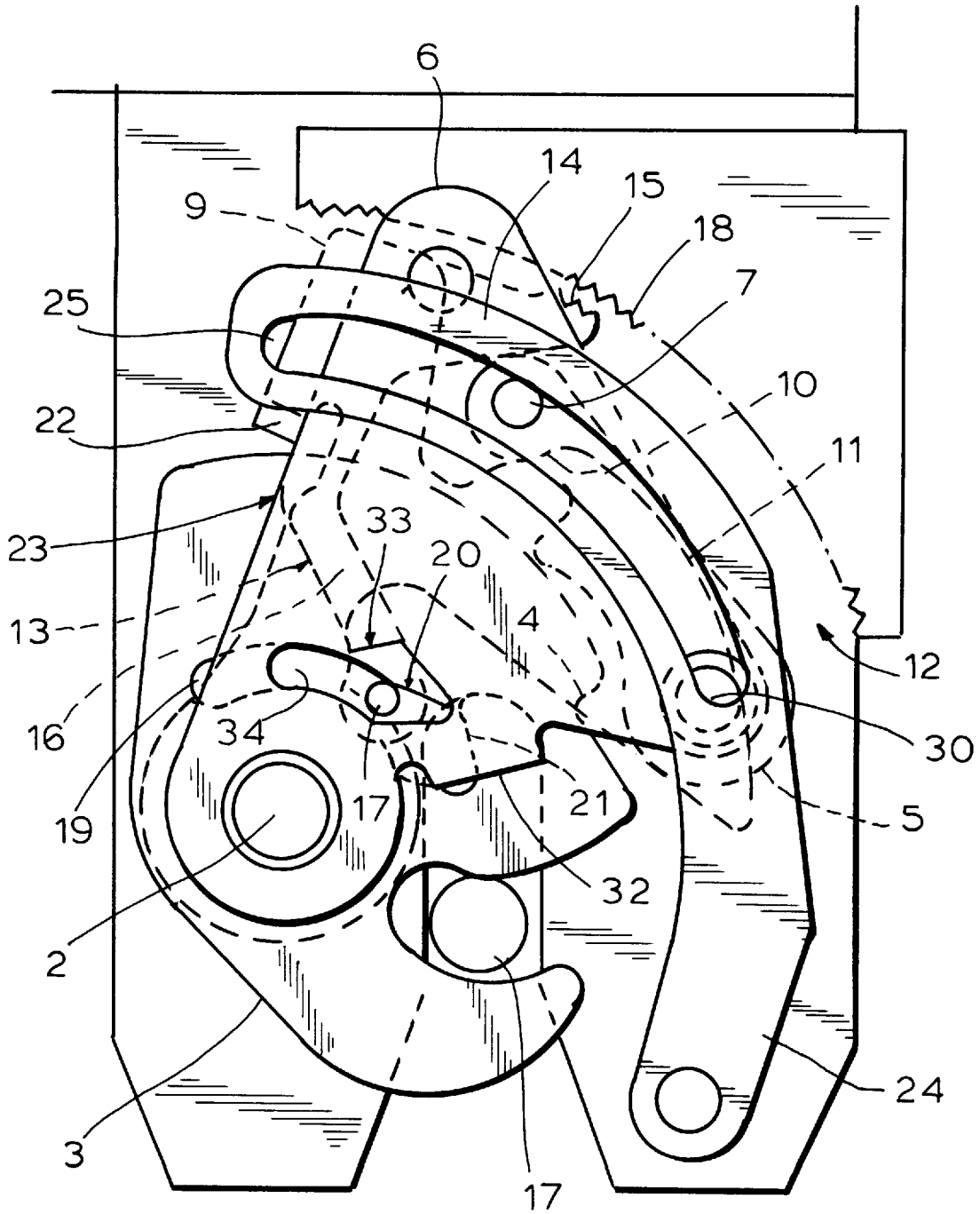
Figure 7:
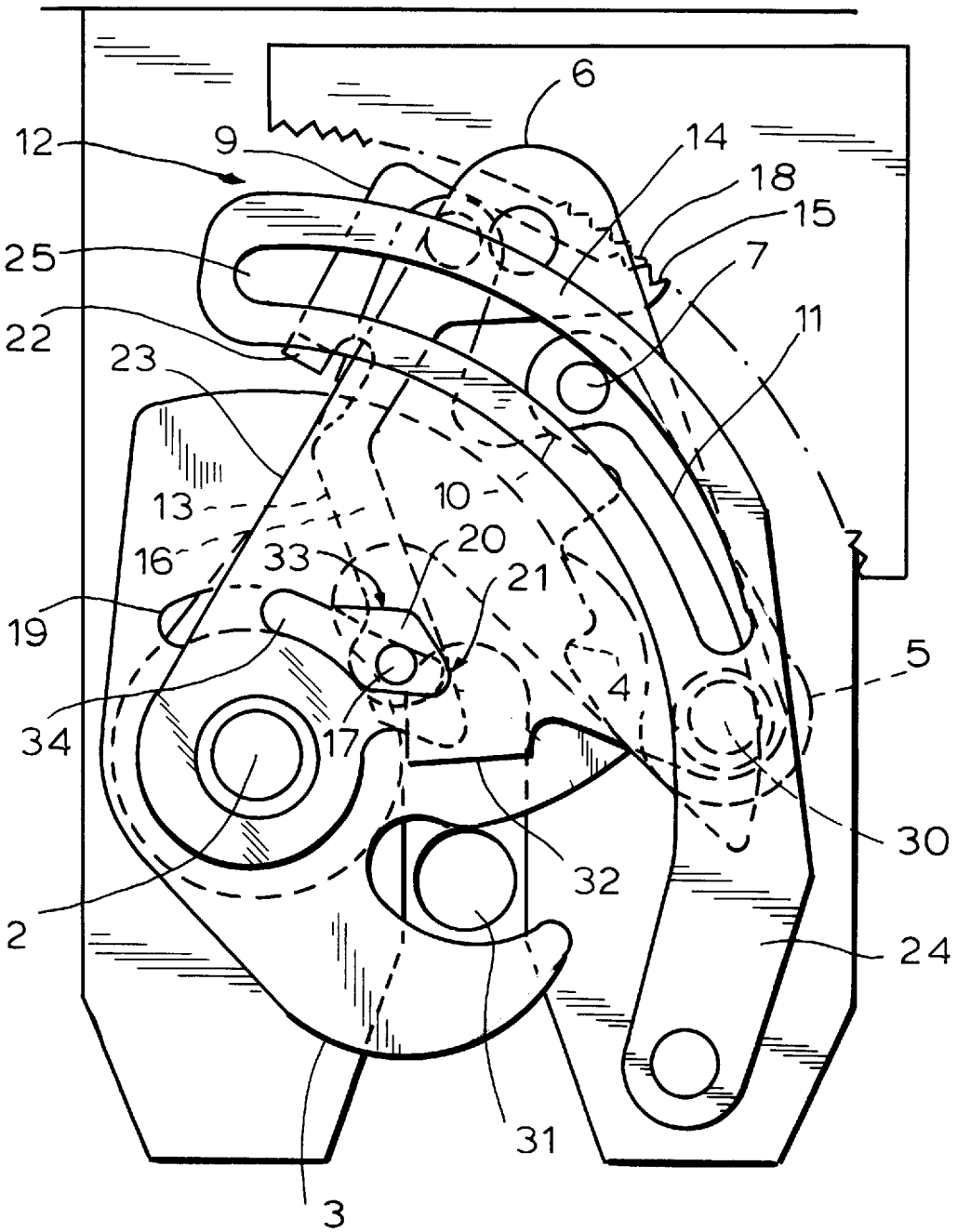
Figure 8:
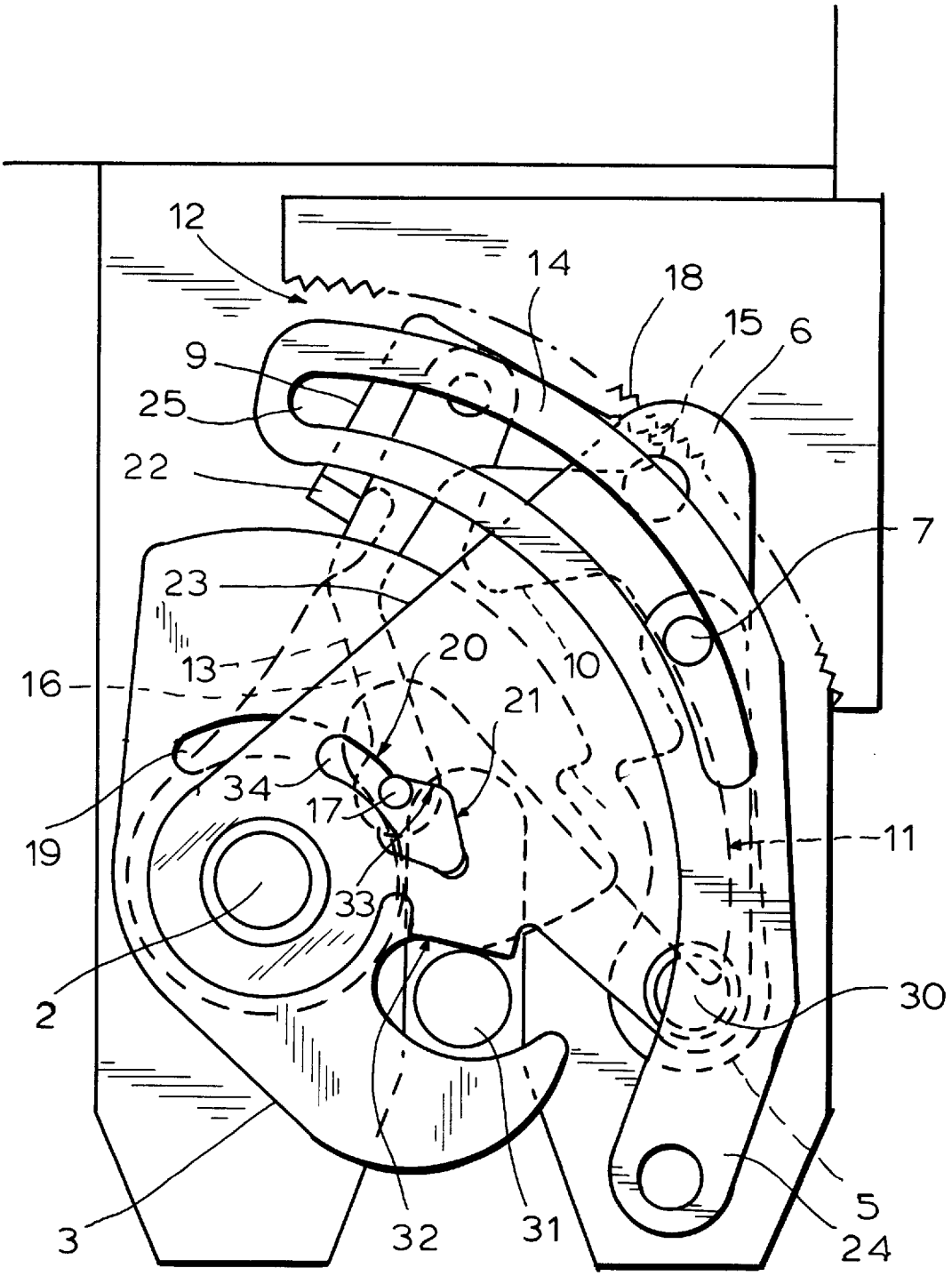
Figure 9:
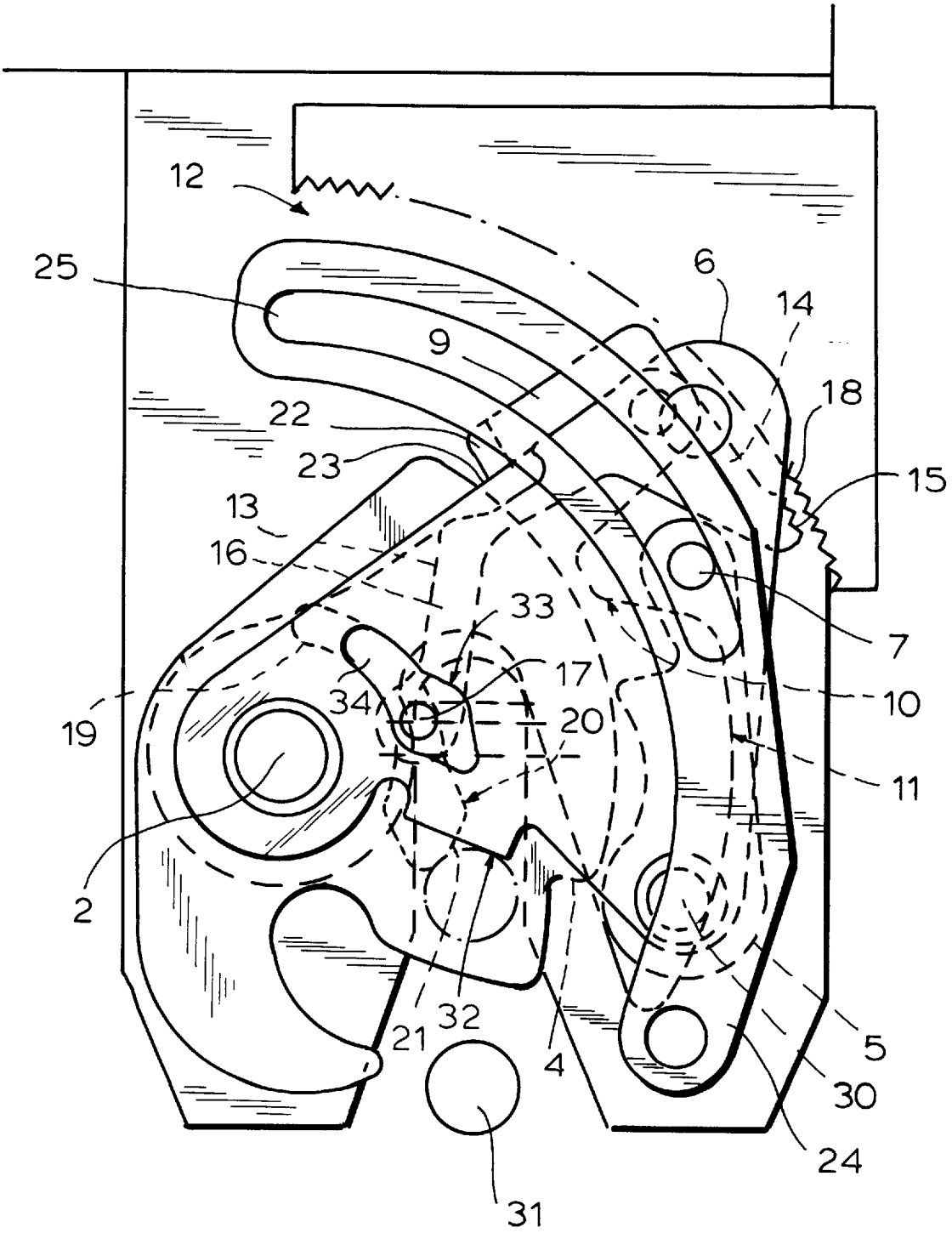

FIG. 6 shows how once the tooth 37 clears the detent 4, the fork 3 can pivot out under the force of its spring 38. The pin 17 moves into the narrow part of the slot 19 of the moving fork 3 so that the lever 13 is pivoted in and the teeth 15 are pulled out of engagement with the teeth 18, thereby freeing the secondary plate 9 to pivot as shown in FIGS. 7, 8, and 9 until the tab 22 engages the edge 23. During subsequent pivoting of the plate 6 by the motor 1 the plate 9 will follow until the pin 17 moves back into the enlarged end of the slot 19 and the arm 13 again pivots out and engages its teeth 15 with the teeth 18, thereby again arresting the arm 13 and plate 9. This second stopping of the rocker plate 9 as shown in FIG. 7 is necessary in order to hold the pin 7 of the pawl 5 on the edge 11, maintaining the pawl 5 in an outer position out of contact with the fork 3.

When the door, here the trunk lid, is then physically opened as shown in FIG. 9 the fork 3 is pivoted all the way out and its slot 19 again engages the pin 17 and once again disengages the teeth 15 and 18 from each other, allowing the plate 9 to once again come to rest with its tab 23 against the edge 22.

If the trunk lid is not opened, for instance because it is covered by snow or otherwise stuck shut, the tab 32 will strike the bolt 31 with some force and should move it at least a little. Then the cam end 33 will be effective to keep the teeth 15 disengaged from the teeth 18.

When the trunk lid is pushed to, the bolt 31 will engage the fork 3 and pivot it back until the pawl 5 catches on the detent 4 again, thereby signalling to the motor 1 via the lever 24 that it should reverse rotate and fully close the latch. The link 8 is moved up and the first rocker plate 6 is also pivoted back as the bolt 31 engages the tab 32. The cam surface 21 engages the pin 17 to pivot in the arm 13 and keep the teeth 15 disengaged from the teeth 18. During the closing operation the release pin 7 is always near the control surface 10 so that at any time the closing movement can be stopped and reversed. Thus if for example something gets stuck between the door and its opening, the door can be opened immediately before damage or injury is serious.

I claim:

1. A motor-vehicle door latch comprising:

a housing;

a fork formed with a detent and pivotal about a main axis on the housing from a latched position retaining a bolt deep in the housing, a semilatched position retaining the bolt shallow in the housing, and an unlatched position permitting the bolt to enter and exit the housing;

a main rocker pivotal about the main axis on the housing with the fork between the latched and semilatched positions;

drive means connected to the main rocker for pivoting it about the main axis between the latched and semilatched positions;

a pawl pivoted on the main rocker about a secondary axis offset from the main axis, provided offset from the main and secondary axes with an axially projecting actuator pin, and displaceable between an inner position engaging the detent and rotationally coupling the fork to the main rocker and an outer position clear of the detent and permitting the fork to rotate independently of the main rocker;

a secondary rocker pivoted on the main axis and provided with a cam formation having a lifting portion engageable with the actuator pin to displace the pawl from its inner position to its outer position and a holding portion engageable with the actuator pin to retain it in its outer position; and means including a coupling and formations on the fork and main rocker for in the semilatched position holding the pawl with the holding portion in the outer position, and in the unlatched position holding the actuator pin out of engagement with the holding portion.

2. The motor-vehicle door latch defined in claim 1 wherein the coupling includes:

an arcuate sector of teeth centered on the main axis on the housing, an elongated circularly arcuate slot formed in the fork centered on the main axis and having an enlarged end formed with a pair of angled camming surfaces, and a lever pivoted on the secondary rocker and having a control pin engaged in the slot, one arm provided with teeth, and another arm provided with an axially extending control pin, the lever being pivotal between an arrested position corresponding to engagement of the control pin in the enlarged end with the lever teeth engaged with the housing teeth and a pivotal position with the lever teeth disengaged from the housing teeth and the control pin out of the enlarged end, a formation on the secondary rocker angularly engageable with the main rocker, and spring means urging the secondary rocker toward the main rocker.

3. The motor-vehicle door latch defined in claim 1, further comprising:

an actuating lever pivotal on the housing about an axis offset from and parallel to the main axis and formed with a slot centered on the main axis and slidably receiving the actuator pin; and a switch operable by the actuating lever on displacement from the actuator pin between the inner and outer positions.

4. The motor-vehicle door latch defined in claim 1 wherein the drive means includes a reversible drive motor having a rotary output, a pinion fixed on the output, a sector gear meshing with the pinion, and a rigid link having one end pivoted on the sector gear and an opposite end pivoted on the main rocker.

5. The motor-vehicle door latch defined in claim 1, further comprising control means connected to the drive means for operating the drive means in steps for establishing the latched position for the main rocker corresponding to an aligned position of a door cooperating with the latch in a vehicle body opening.

* * * * *